United States Patent [19]

Blonigen

[11] 4,086,715

[45] May 2, 1978

[54] MULTIPLE RATING DEVICE

[76] Inventor: Quentin P. Blonigen, 707 N. Mill St., Clio, Mich. 48420

[21] Appl. No.: 679,014

[22] Filed: Apr. 21, 1976

[51] Int. Cl.[2] ..... G09F 9/40

[52] U.S. Cl. ..... 40/504; 116/133; 40/506

[58] Field of Search ..... 116/133; 40/68, 68.4; 35/77, 66

[56] References Cited

U.S. PATENT DOCUMENTS

| | | | |
|---|---|---|---|
| 270,163 | 1/1883 | Walsh | 35/77 |
| 2,019,816 | 11/1935 | Hunt | 116/133 |
| 3,084,457 | 4/1963 | Schott | 35/66 |
| 3,333,356 | 8/1967 | Bosland | 40/68 |
| 3,400,057 | 9/1968 | Coates | 35/66 |
| 3,434,454 | 3/1969 | Ashton | 116/133 |

*Primary Examiner*—S. Clement Swisher
*Assistant Examiner*—Denis E. Corr
*Attorney, Agent, or Firm*—Basile and Weintraub

[57] ABSTRACT

A device for indicating and surveying various types of services includes a housing having printed indicia rotatable drums mounted therewithin which display selected indicia according to the user's selection. Preformed indicia on the exterior of the housing are associated with the drums to provide a correlation therebetween. The device, also, includes an erasable writing surface, a bracket or similar attachment for suspending the device from a wall or the like, as well as means for securing a writing implement to the housing.

6 Claims, 6 Drawing Figures

MULTIPLE RATING DEVICE

BACKGROUND OF THE INVENTION

1. Field of the Invention

The present invention pertains to indicating devices. More particularly, the present invention pertains to visual indicating devices having adjustable indicia associated therewith. Even more particularly, the present invention concerns a visual indicating device of the type denoted having preformed indicia and erasable writing surfaces associated therewith.

2. Prior Art

There has been disclosed heretofore in the art a plurality of visual indicating devices having adjustable indicia associated therewith. See, inter alia, U.S. Pat. Nos. 2,976,621; 3,728,807 and 3,776,177. Such devices, however, are, generally, restricted to a single function, i.e. attendance reporting; teaching spelling and the like. The present invention, on the other hand, by proper adjustment can be utilized as an educational report card; restaurant service and food rating device, and for rating other various services.

SUMMARY OF THE INVENTION

The present invention provides a variable or multiple indicating device which comprises a housing having a plurality of viewing openings formed therein. Disposed within the housing and associated with each opening is a rotatable drum having sets of indicia circumferentially disposed around the drum. The sets of indicia are adapted to be displayed through the openings, such that only one set of indicia on each drum is visible at any one time.

Adjacent each viewing opening is preformed indicia which correlates to the indicia on the associated drum.

The device hereof, also, includes means for mounting the device on a wall or other structure.

The present invention further contemplates the formation of an erasable writing surface on the housing whereby written notations can be made. Also, a writing implement holder is formed with the device.

For a more complete understanding of the present invention reference is made to the following detailed description and accompanying drawing. In the drawing like reference characters refer to like parts throughout the several views, in which:

DESCRIPTION OF THE PREFERRED EMBODIMENTS

Figure 1:
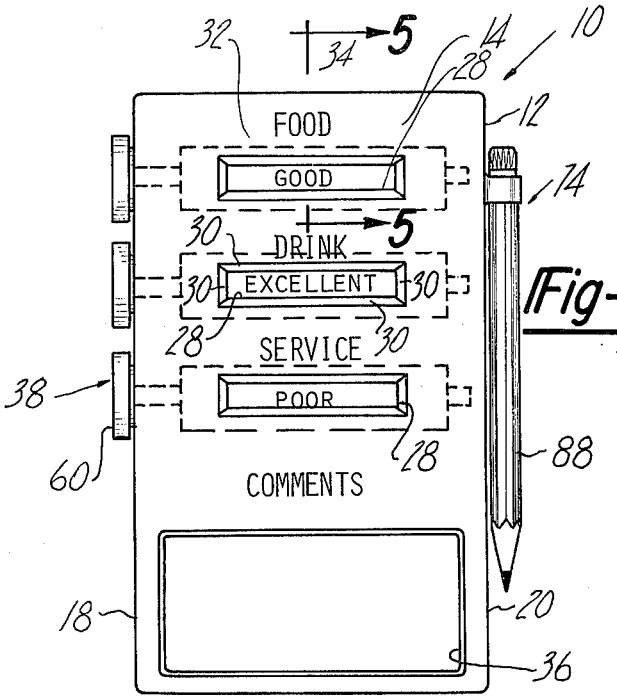
FIG. 1 is a front elevational view of a device in accordance with the present invention.

Now, with reference to the drawing, there is depicted therein a device in accordance with the present invention, and generally denoted at 10. The device 10 comprises a housing 12 comprising front and rear panels 14, 16 respectively, side panels 18, 20 and top and bottom panels 22, 24, respectively. The panels cooperate to define the housing 12 with a hollow or open interior 26.

The front panel 14 is provided with a plurality of viewing openings 28 which permit visual observation of indicia, in a manner to be described subsequently. In forming the openings 28 the peripheral edges thereof 30 are inwardly directed into the interior 26 of the housing 12 and function as detents for rotatable drums, also, in a manner to be described subsequently.

Disposed above each of the viewing openings 28 is an erasable writing surface 32. The surface is formed by treating the prescribed area with an alkali or acid, for metal or with a suitable solvent, for a plastic, in a known manner, to thereby provide an erasable surface. Within the surface 32 there is provided suitable indicia 34 associated with the performances to be rated. Alternatively, the panel 14 can be provided with pre-formed indicia 34, such as by molding, engraving or the like.

The front panel 14 further includes a writing surface 36 for writing messages thereon. The writing surface 36 is formed in the manner heretofore described.

The present invention further comprises means, generally, indicated at 38, which carry indicia for viewing through the viewing openings 28. The means 38 comprises a rotatable drum 40 which is journalled on the shaft 42. The drum 40 is movable upon rotation with the shaft 42. The drum 40 includes a plurality of raised portions or embossments 44 integrally formed with the drum and circumferentially disposed therearound. On each raised portion of the drum is pre-formed indicia 46. The indicia 46 are pre-formed and pre-determined to correlate to the indicia 34 provided adjacent the viewing opening 28.

Figure 5:
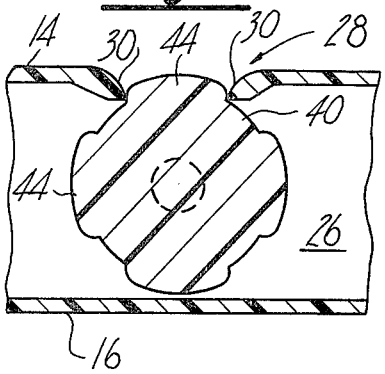
FIG. 5 is a cross-sectional view taken along the line 5—5 of FIG. 1.
Figure 6:
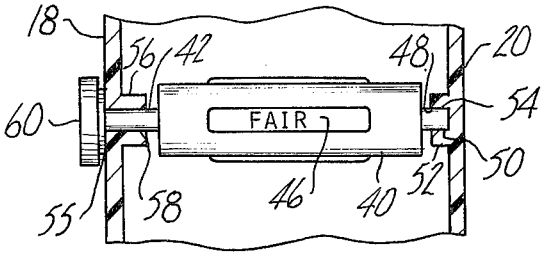
FIG. 6 is a cut-away, broken view of the present device depicting the rotatable drum.
Figure 4:
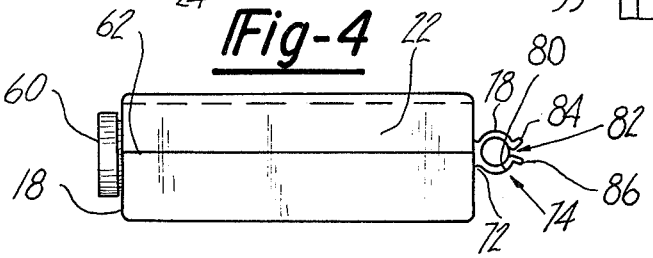
FIG. 4 is a top view of the device.

Referring to FIGS. 5 and 6 there is depicted therein the mounting of the drum and the shaft. The drum 40 is mounted on the shaft such that the raised portions thereof register with the openings 28. In this manner the detent formed by the edges 30 lock the desired raised portion in position, as shown. This renders the indicia 46 visible through opening 28.

The shaft 42 has its free end 48 seated in a housing 50 formed in the side panel 20. The housing comprises an annular projection 52 which projects inwardly into the interior 26 of the housing and which is integrally formed with the interior of the side panel 20. A partial bore 54 or central opening of the projection receives the free end of the shaft 42. The opposite end 55 of the shaft 42 extends through an opposed annular projection 56 and through bore 58, as shown. The end 55 of the shaft 42 extends through the side panel 18 and exits therefrom. Secured onto the end 55 is a rotatable knob 60. The knob is securely connected to the shaft end by any suitable mode. Thus, by rotating the knob, the shaft and drum are caused to likewise rotate.

It is, also, possible in accordance herewith to provide a plurality of individually manually rotatable drums on the shaft. Each such drum is provided with varying indicia, including numerals and letters, circumferentially disposed therearound. Such individual drums are illustrated in U.S. Pat. No. 3,776,177. By providing such individual drums there is accorded an infinite number of conceivable messages to be visually displayed through the openings.

It is, also, contemplated herein that the housing 12 be separable along dividing line 62 with suitable interlocking means (not shown) being associated therewith to maintain the device in a closed state. By rendering the housing separable access to the interior 26 is afforded.

By frictionally mounting the drum 40 on the shaft 42, the drum can be changed by removing the drum, per se, from the shaft and mounting another drum thereon. This is especially useful when varying the reporting function of the device.

It is to be understood with respect to the preceding-that the description has been made with reference to the indicia associated with a single viewing opening. Associated with each viewing opening is an indicia display means of the type heretofore described.

Figure 2:
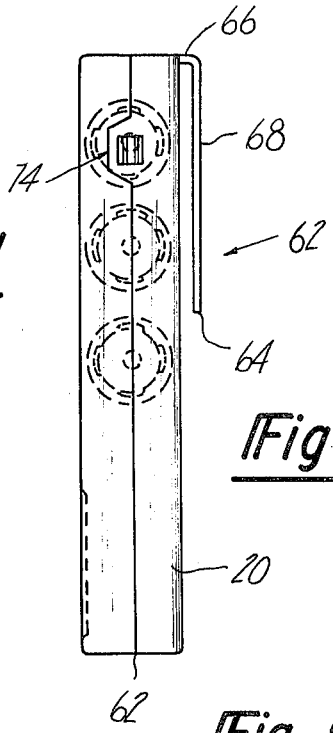
FIG. 2 is a side elevational view of the device.
Figure 3:
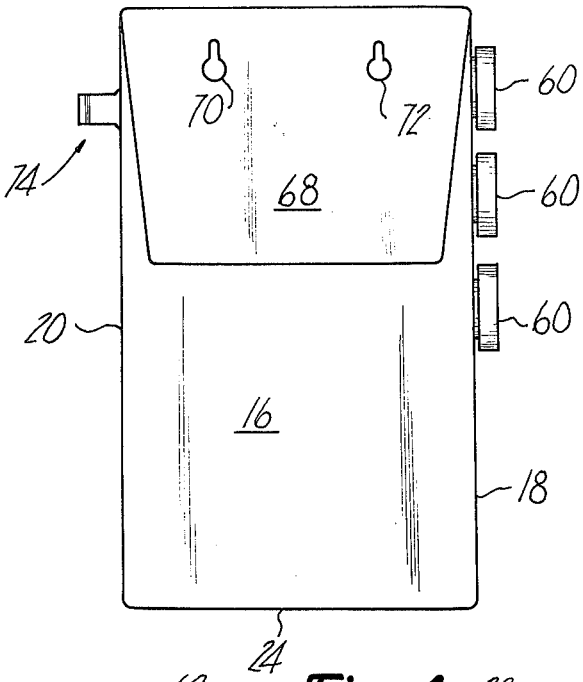
FIG. 3 is a rear elevational view of the device embodying the present invention.

Referring, again, to the drawing, and, in particular, FIGS. 2 and 3, there is depicted therein means for suspending the device, generally, indicated at 62. The means 62 comprise an L-shaped bracket plate 64 having a first leg 66 and a second leg 68. The first leg 66 is secured to the rear panel 16 proximate the junction thereof with the top panel 22. The leg 66 projects outwardly away from the rear panel. The second leg 68 downwardly depends from the first leg and is integrally formed therewith.

A pair of spaced apart, aligned apertures 70, 72 are formed through the second leg 68, as shown. The aperture can be used to mount the device to suitable mounting means such as nails, screws or the like. Alternatively, in lieu of mounting means, the second leg 68 can be slidingly inserted into a wall-mounted pocket or the like (not shown).

As hereinbefore noted, and as shown in FIGS. 1, 2, 3 and 4, the present invention further comprises means for holding or retaining a writing implement, generally, indicated at 74. The means 74 comprises a projection 76 outwardly extending from side panel 20. Integrally formed with the projection and projecting outwardly therefrom is a pair of opposed arcuate sections 78, 80. The sections do not quite abut and, therefore, provide a gap 82 at their outer termini. The termini of the sections 78, 80 are provided with guides 84, 86, respectively, which guide a writing implement, such as pencil 88, into the gap 82 and the space defined between the two arcuate sections. By forming the sections from a resilient, flexible material the writing implement is frictionally retained in the space until ready for use. Although, not shown, alternatively, the means can comprise a piece of woven nylon fabric VELCRO® secured to the side panel. By placing a similar piece of fabric on the implement the writing implement can, also, be detachably secured to the device.

It is to be appreciated from the preceding that there has been described a multifunctional display device for visually correlating a rating to a prescribed function or service which can utilized in a plurality of environments. In addition, it is contemplated herein, that the device be used to teach sign language. This is achieved by showing varying finger or digit positions on the rotatable drum, with a concommitant display in surface 32 of the associated written word.

Having, thus, described the invention what is claimed is:

1. A multiple use rating device, comprising:

(a) a separable housing having an open interior, the housing being defined by a front panel, a rear panel, a pair of opposed side panels, a top panel and a bottom panel, (b) a yieldable viewing opening provided in the front panel, the edges of the panel about the opening being yieldable and defining a detent, (c) a first set of indicia provided on the front panel proximate the viewing opening, (d) a shaft traversing the housing and disposed interiorly thereof, the shaft having one end thereof seated in a housing formed on the interior of one side panel, the other end of the shaft extending through an opposed housing formed on the other side panel, the other end of the shaft extending exteriorly of the device, (e) a rotatable drum mounted on the shaft, the drum having a plurality of raised portions, each raised portion being registerable with the viewing opening, the raised portions being circumferentiallydisposed around the drum, the raised portions being fixed in position by the detent, (f) a second set of indicia provided on each of the raised portions, the second set of indicia being correlated to the first set of indicia, (g) means for detachably securing a writing implement to the device, and (h) means for rotating the shaft mounted onto the other end of the shaft exteriorly of the housing.

2. The device of claim 1 which further comprises:

a writing surface etched on the front panel proximite the viewing opening, the first set of indicia being formed on the writing surface.

3. The device of claim 2 which further comprises:

a second writing surface etched on the front panel.

4. The device of claim 1 wherein:

the housing is separable to permit access into the interior.

5. The device of claim 1 which further comprises:

means for suspending the device, the means being secured to the rear panel.

6. The device of claim 1 wherein:

the raised portions are integrally formed with the drum, the drum and raised portions defining a unitary member.

* * * * *